US005917527A

United States Patent [19]

Boyd et al.

[11] Patent Number: 5,917,527

[45] **Date of Patent: *Jun. 29, 1999**

[54] INK-JET PEN WITH NEAR NET SIZE POROUS MEMBER

[75] Inventors: Patrick V. Boyd, Albany; Mark C. Huth, Corvallis; John M. Altendorf, Corvallis; Joseph R. Elliot, Corvallis, all of Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/747,135

[22] Filed: Nov. 12, 1996

Related U.S. Application Data

[63] Continuation of application No. 08/331,848, Oct. 31, 1994, abandoned.

[51] Int. Cl.[6] ..... B41J 2/175

[52] U.S. Cl. ..... 347/87; 347/85

[58] Field of Search ..... 347/85, 86, 87

[56] References Cited

U.S. PATENT DOCUMENTS

| | | | |
|---|---|---|---|
| 4,929,969 | 5/1990 | Morris . | |
| 5,025,271 | 6/1991 | Baker et al. | 347/87 |
| 5,213,751 | 5/1993 | Terry | 264/321 |
| 5,440,333 | 8/1995 | Sykora et al. | 347/87 |
| 5,448,275 | 9/1995 | Fong | 347/87 |
| 5,450,112 | 9/1995 | Scheffelin | 347/87 |

FOREIGN PATENT DOCUMENTS

| | | | |
|---|---|---|---|
| 0424133 | 4/1991 | European Pat. Off. | B41J 2/175 |
| 0520695 | 12/1992 | European Pat. Off. | B41J 2/175 |
| 520695 | 12/1992 | European Pat. Off. | 347/86 |
| 0603515 | 6/1994 | European Pat. Off. | B41J 2/175 |
| 603515 | 6/1994 | European Pat. Off. | 347/86 |
| 4121962 | 1/1993 | Germany | B41J 2/17 |

*Primary Examiner*—Valerie Lund

*Attorney, Agent, or Firm*—Kevin B. Sullivan; H. Brian Davis

[57] ABSTRACT

Disclosed is a novel inkjet print cartridge (pen) in which a body of polyurethane foam is inserted into an ink chamber of the pen for ink containment and backpressure. The ink chamber has a tall narrow aspect ratio. The body of polyurethane foam is felted in the width direction of the pen to have a width less than 20% of its pre-felted width. After felting, the body of foam is cut to have a "near net size" as the interior volume of the ink chamber. Specifically, the pre-insertion volume is less than about 130% of the interior volume of the ink chamber. The substantial felting in the width direction provides sufficient stiffness to the foam that it can be inserted into the tall, narrow aspect ratio ink chamber.

13 Claims, 6 Drawing Sheets

FIG. 2
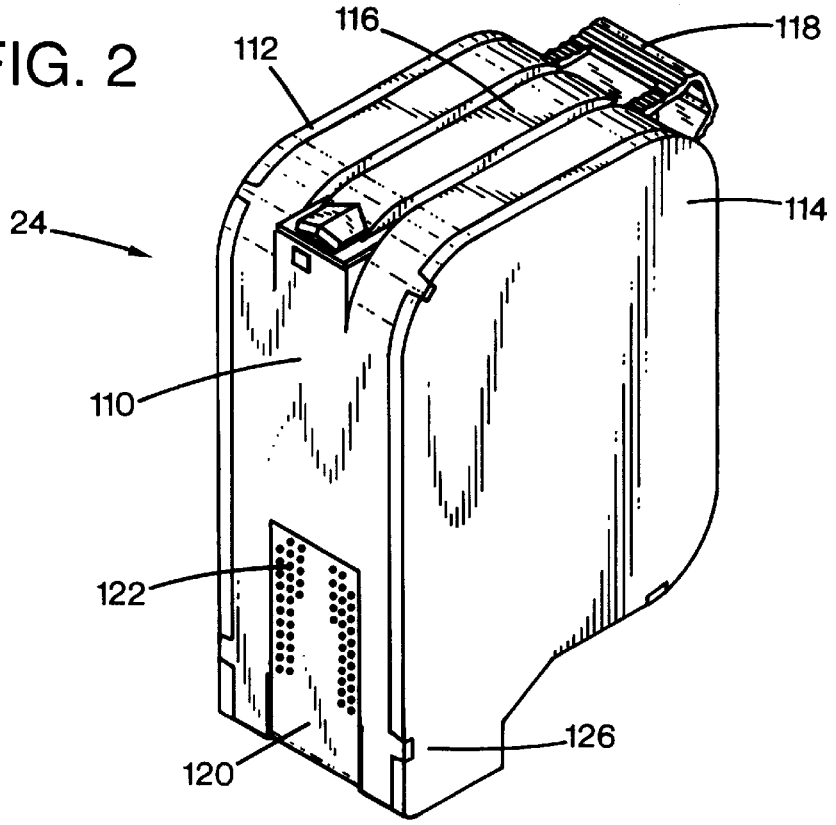
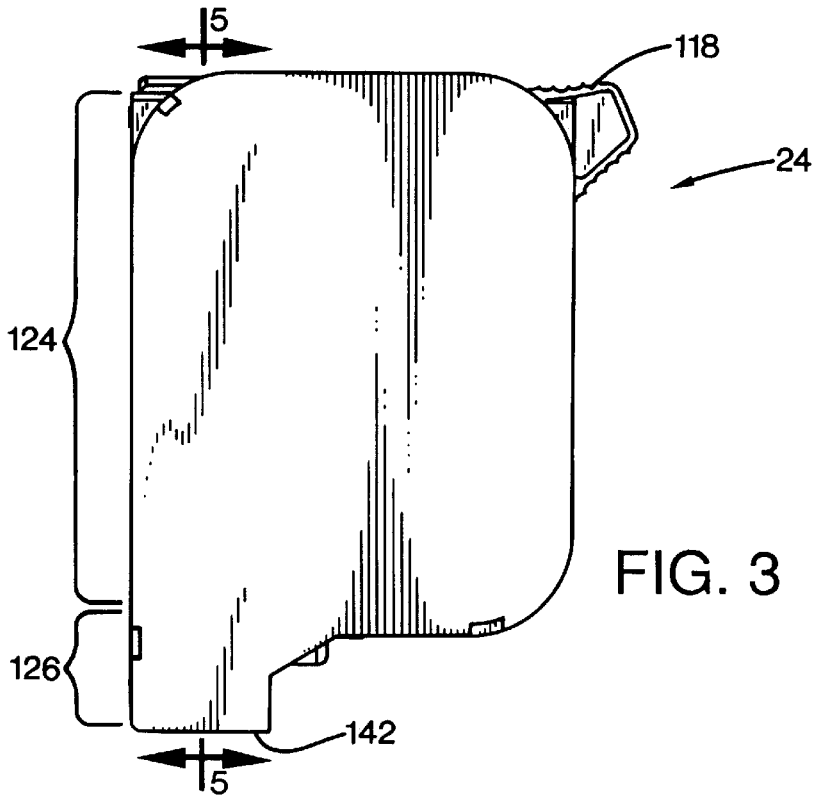
FIG. 3

INK-JET PEN WITH NEAR NET SIZE POROUS MEMBER

CROSS REFERENCE TO RELATED APPLICATION

This is a continuation of application Ser. No. 08/331,848 filed on Oct. 31, 1994, now abandoned.

BACKGROUND OF THE INVENTION

1. Field of the Invention

The present invention is directed to device and method for storing ink in a reticulated foam for use in ink-jet printing, and is particularly directed to reticulated foam that has a volume, before being inserted in the ink chamber, that is close to its net volume after insertion.

2. Description of the Related Art

Ink-jet printers commonly employ ink-jet print cartridges, or "pens," which include a sophisticated printhead and an attached ink chamber filled with a supply of ink. The printhead is a micromechanical part that contains an array of miniature thermal resistors or piezoelectric transducers that are energized to eject small droplets of ink out of an associated array of nozzles. In some cases the printhead is permanently attached to the ink supply, and in others the ink supply can be separately replaced. The pen is mounted in a carriage in the printer where the pen electrically interfaces with the printer. The printer scans the pen back and forth across the print medium (e.g., paper) as the pen ejects small droplets from the nozzles in selected matrix patterns, to thereby print a swath of the desired alphanumeric characters or graphics. After each swath of printing, the printer advances the medium incrementally to begin a new swath. Successive swaths are printed in this manner to complete the desired alphanumeric characters or graphics on the medium.

The ink in the pen must be held in the ink chamber at less than atmospheric pressure, so that the ink does not drool out of the nozzles when the nozzles are not firing. However, this negative relative pressure, or backpressure, must not be so great that air is gulped into the interior of the firing chambers, thereby causing them to "deprime" and no longer function. Various mechanisms have been devised to provide the appropriate backpressure, such as resilient bladders and combinations of springs and flexible bags.

One of the most reliable backpressure systems uses a porous material, such as synthetic foam, in the ink tank. Ink is injected into the foam and the foam retains the ink at the appropriate backpressure by capillary action. U.S. Pat. No. 4,771,295 (Baker '295), which is assigned to Hewlett-Packard Company (the assignee of the present invention), discloses an ink-jet pen that uses synthetic foam for ink retention and backpressure. A key feature of the pen disclosed in Baker '295 is an ink pipe that extends upward from a bottom wall of the pen body and into compressive contact with the foam. The ink pipe is the fluid conduit for the ink from the foam to the printhead. The ink pipe locally compresses the foam to thereby increase its capillarity in the region of the ink pipe. As ink is depleted from the foam, the increased capillarity near the ink pipe tends to draw ink from all other portions of the foam toward the ink pipe, so that the maximum amount of ink can be drawn from the foam for printing.

It is important in foam-based pens to keep the foam in secure contact with the ink pipe to maintain the compressive capillarity and the ink seal between the pipe and the ink-filled foam. If this compressive contact is broken an air path forms from the ambient air around the sides of the foam and into the interior of the ink pipe, resulting in a catastrophic deprime of the pen. To ensure adequate compressive contact between the ink pipe and the foam, prior art pens have employed bodies of foam that are larger in volume than the ink chamber they are to fill. The foam body must therefore be compressed by some mechanism during insertion. Once inserted, the compression is released so that the sides of the foam can expand into resilient contact with the walls of the ink chamber. This compressive contact with the walls of the ink chamber keeps the foam in place and in contact with the ink pipe. In many cases, such foam bodies have pre-insertion volumes that can be 50% or more greater than the interior volume of the ink chamber.

It is very important to minimize or avoid wrinkling the foam or causing other compression anomalies in the foam during the process of inserting the foam into the ink chamber. Such localized wrinkles and anomalies introduce unintended regions of higher compression. These regions of increased compression will have a higher capillarity than the surrounding foam, and ink will be stranded at these locations. Ink thus stranded is wasted and will not be available for printing.

The mechanisms needed to insert foam members that have large volumes relative to the internal volume of the ink chamber add complexity and expense to the assembly of the pen. One such mechanism, for example, involves parallel plates that squeeze the foam to a width smaller than the ink chamber. After the plates and the foam are lowered into the ink chamber, a separate mechanism pushes the back of the foam while the plates are removed from the pen body in a shuffling or ratcheting motion.

The complexity of foam insertion mechanisms is compounded as ink chambers become taller and more narrow. It has become increasingly important to make ink-jet pens as narrow as possible. The overall width of the pen influences the width of the printer and the amount of desk space the printer takes up. In addition, when printing with multiple pens, such as in color printing, print quality can be enhanced by making the pens narrower. Narrower pens allow the printheads of the pens to be more closely spaced so that during printing, as the pen is scanned across the print medium, less time goes by between ejection of the different colored droplets. On the other hand, users of printers desire that ink-jet pens last longer, in other words, that they hold more ink. Often the best way of increasing the volume of ink while maintaining a narrow profile is to make the pen taller.

However, the taller and more narrow the pen is, the more difficult it is to properly insert foam into the ink chamber. Particularly with pens that load the foam from the top down into the pen, the taller the pen is, the more likely it will be that undesirable wrinkles or other anomalies will form in the foam as the foam is loaded into the pen. Also, the taller the pen is, the more chance there is that friction between the foam and the interior walls of the pen body during insertion will impede the desired compressive force between the foam and the ink pipe. The mechanisms needed to insert foam bodies that have a substantially greater pre-insertion volume than the ink chamber where the ink chamber is tall and narrow may be prohibitively complex.

There remains a need for a foam-based ink containment device that avoids the problems associated with insertion of large foam bodies, and which at the same time provides adequate sealing between the foam and the ink pipe. This solution would preferably allow for top-down insertion into ink-jet pens having tall, narrow aspect ratios.

SUMMARY OF THE INVENTION

The present invention provides an ink containment device and method for an ink-jet printing system that includes an ink chamber having an internal volume. A body of synthetic reticulated foam is inserted into the ink chamber. The foam body has a volume before insertion into the ink chamber less than about 130% of the internal volume of the ink chamber.

The invention provides a solution to the problems associated with the insertion of foam bodies into ink chambers, particularly ink chambers with narrow aspect ratios. Since the volume of the foam and/or its width is close to the volume and/or width of the ink chamber, problems relating to foam insertion into narrow aspect-ratios pens are minimized. It would be very difficult, if not impossible, to insert foam members into tall, narrow aspect-ratio chambers, such as the center chamber of the illustrated embodiment, without using foam members made according to the present invention.

BRIEF DESCRIPTION OF THE DRAWINGS

FIG. 2 is a perspective view of a pen of the invention.

FIG. 3 is a side view of the pen of FIG. 2.

DESCRIPTION OF THE PREFERRED EMBODIMENTS

Figure 1:
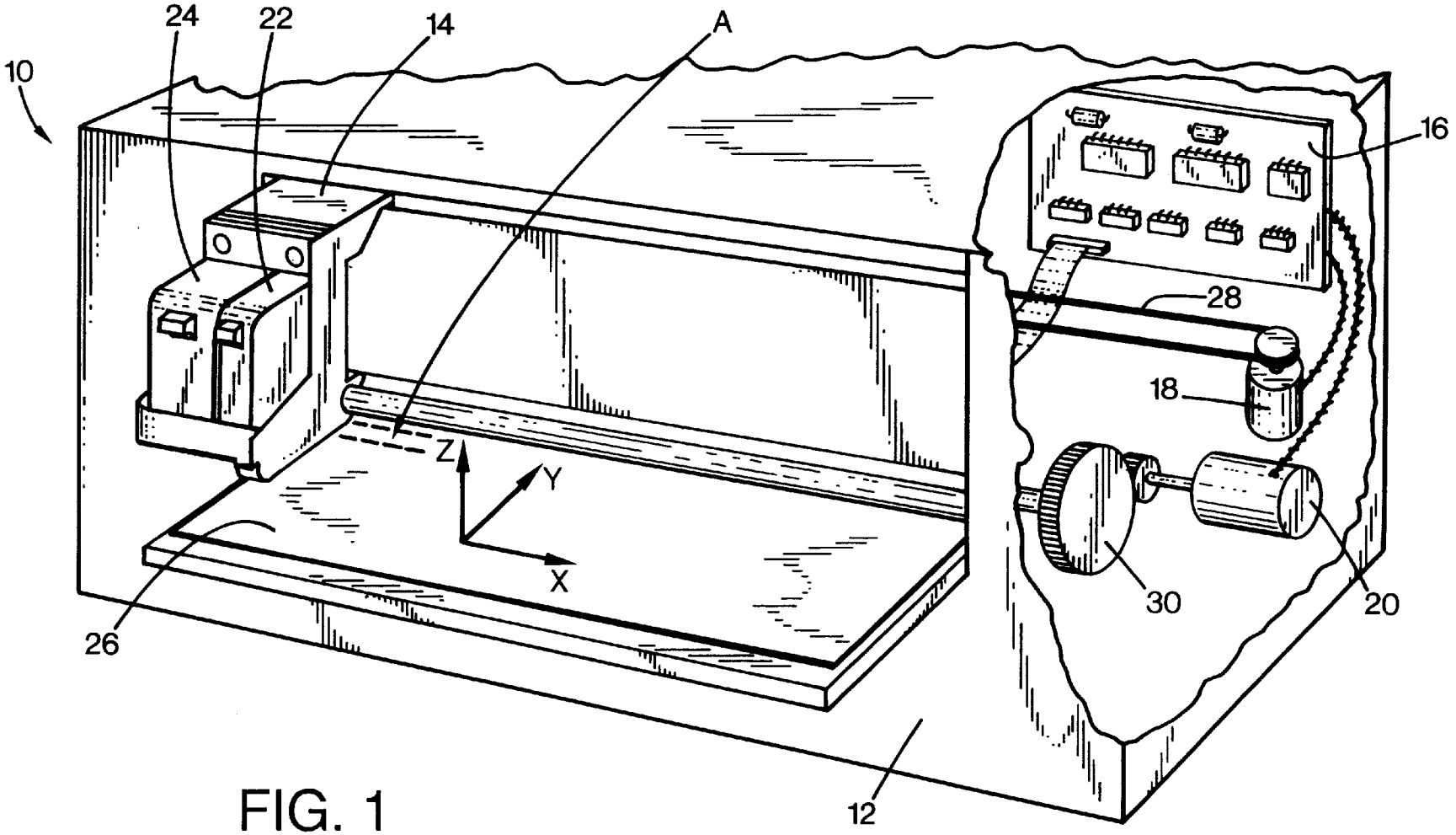
FIG. 1 is a perspective, partial cut-away, view of a printer employing an ink-jet pen of the invention.

FIG. 1 illustrates an ink-jet printer that uses a pen of the invention. The printer is illustrated only schematically, and paper input trays, paper output trays and other options are not illustrated. The printer, generally indicated at 10, includes a housing 12, carriage 14, controller 16, carriage drive motor 18 and paper drive motor 20. A monochrome black pen 22 and a multi-chamber three-color pen 24 are mounted in carriage 14 as shown. A print medium 26 is shown in printer 10 to be printed on by pens 22 and 24. Print medium 26 may be, for example, paper, transparency film, envelopes, or other print media.

Printer 10 activates pens 22 and 24 to print upon print medium 26 in a manner well known in the art, but briefly described as follows. Carriage advance motor 18 is linked to carriage 14 by means of belt 28. Controller 16 activates carriage advance motor 18 to drive carriage 14 to the right or to the left in the scanning direction as indicated by the arrow marked X. Each time carriage 14 moves to the right or to the left, the printer prints a "swath" on medium 26. Media advance motor 20 is connected to gearing mechanism 30 (schematically illustrated). Gearing mechanism 30 is connected to drive rollers and pinch rollers (not shown), which in turn directly interface with the medium 26 in a manner well known in the art.

After carriage 14 has completed one swath of printing, controller 16 activates media advance motor 20 to move the medium 26 one swath width in the direction marked Y, which is the media-advance direction. After another swath is completed, the medium 26 is advanced another swath width in direction Y so that another swath may be printed. In this manner, successive swaths are printed until all of the desired alphanumeric characters and/or graphics are printed on medium 26.

The area of medium 26 that is being printed upon may be referred to as the print zone, marked A. The print zone A may be considered to be the current swath width area that is being printed upon as carriage 14 scans across medium 26. The width of various components of pens 22 and 24 are measured in the scanning direction X. The length of components of pens 22 and 24 are measured in the media-advance direction Y. The height of pens 22 and 24 is measured in the direction marked Z, which is normal to the print medium 26 at the print zone A.

As shown in FIGS. 2 and 3, multi-chamber pen 24 includes a main body member 110, side cover members 112 and 114, center cover member 116, finger tab 118, and a flex strip 120 containing contact pads 122. The finger tab 118 is included to allow the user to more easily insert the pen 24 into the printer carriage 14 as shown in FIG. 1. The main body member 110 of pen 24 is divided mainly into two parts, the main ink cavity portion 124 and the nose portion 126.

Figure 4:
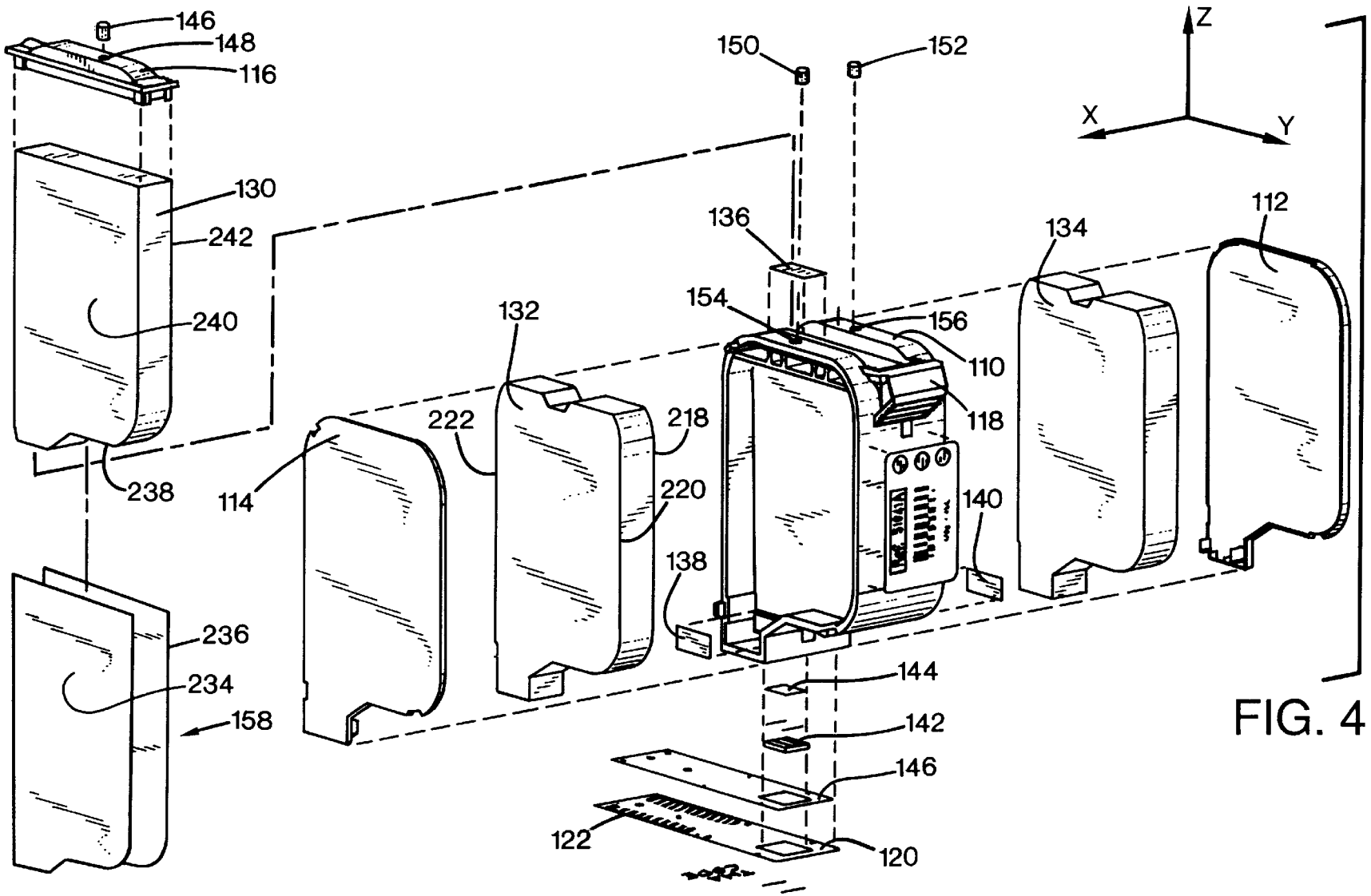
FIG. 4 is an exploded perspective view of a pen of the invention.

As shown in FIG. 4, the multi-chamber pen 24 also includes center porous member 130, side porous member 132, side porous member 134, center filter 136, side filters 138 and 140, and printhead 142. Printhead 142 is attached to main body member 110 by means of a heat curable epoxy layer 144. Flex strip 120 is heat staked to main body member 110. Flex strip 120 is a custom-made tape automated bonding (TAB) circuit formed of a polymer film with custom designed copper traces that connect to contact pads on the printhead. An adhesive layer 146 of thermoplastic bonding film is laminated to flex strip 120 before it is heat staked to the main body member. Adhesive layer 146 melts and aids the bonding of flex strip 120 to the main body member and helps provide electrical insulation for the conductors on the flex strip. Custom-made TAB circuits are commonly available and widely used in the electronics industry. The printer into which the pen 24 is inserted interfaces with contact pads on flex strip 120 to provide the appropriate driving signals to cause the resistors on the printhead to fire at the appropriate time.

Filters 136, 138 and 140 are attached to main body member 110. A threaded nylon plug 146 is pressed into hole 148 formed in center cap 116. Likewise, threaded nylon plugs 150 and 152 are pressed into holes 154 and 156 formed in main body member 110. The helical thread pattern on these plugs provides an air path to allow the pen to breathe in air as ink is depleted from the foam members 130, 132, and 134. The long narrow channel of this helical pattern acts as barrier to vapor diffusion from the inside of the pen to the ambient environment.

A low friction cover sheet 158 is provided to cover the sides of foam member 130. Foam member 130 is inserted into center chamber 160 of main body member 110. Foam member 132 is inserted into side chamber 162, and foam member 134 is fitted into side chamber 164. Foam members 130, 132, and 134 are preferably formed of a polyether based polyurethane open cell foam without anti-oxidant. Other porous materials may also be used, such as innately reticulate thermoset melamine condensate. After the foam members are inserted into the main body member, cover members 114, 112, and center cover member 116 are ultrasonically bonded to the main body member 110 to enclose the foam members 130, 132, and 134 within the pen. Once the step of bonding cover members 112, 114, and 116 is complete, ink is injected into foam members 130, 132, and 134.

Figure 5:
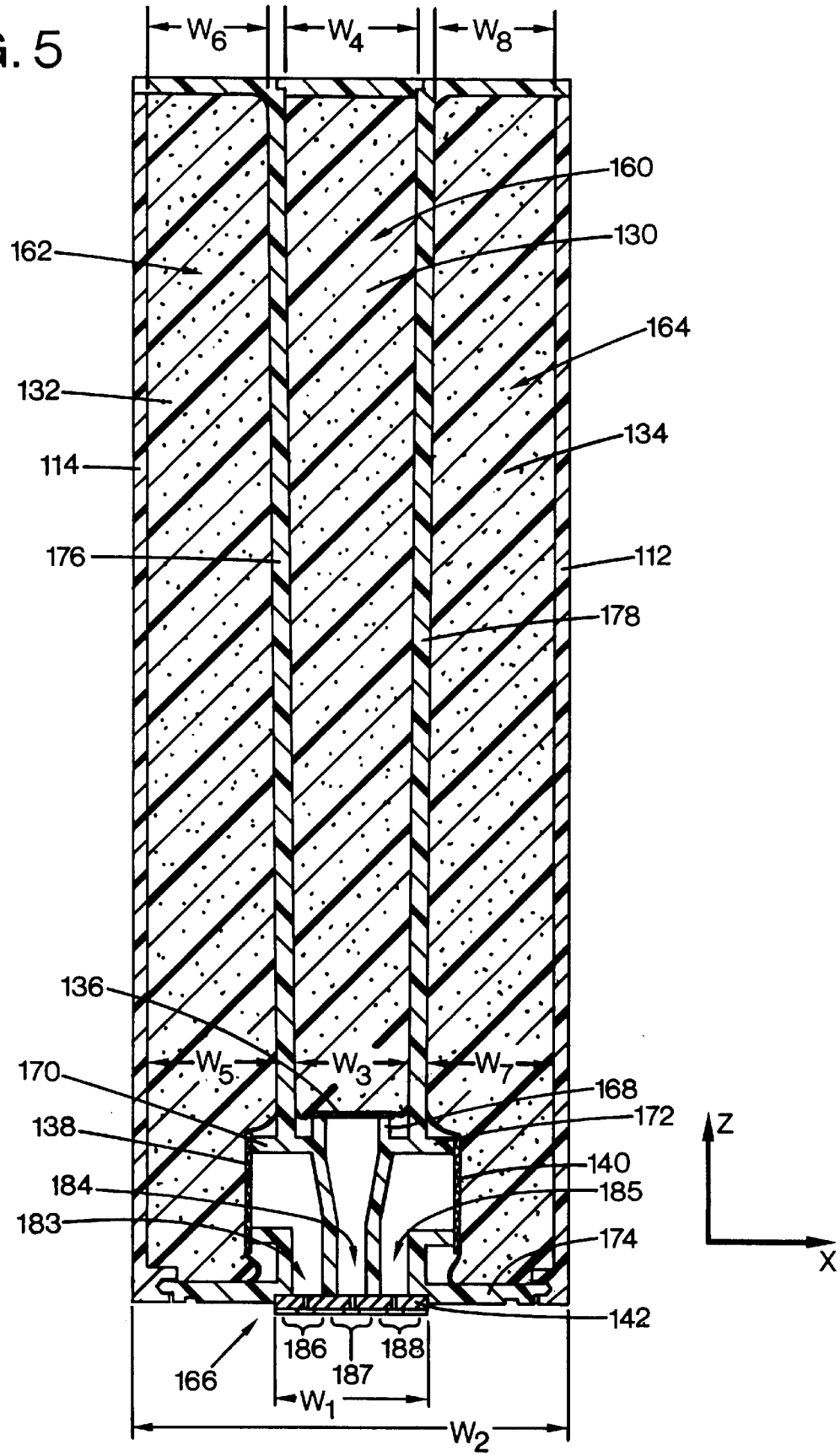
FIG. 5 is a sectional view of a portion of an assembled pen, also taken along section line 5—5 of FIG. 3 as viewed to the left in FIG. 3.

As shown in FIG. 5, main body member 110 is formed as a single unitary part to include the previously described center chamber 160, and side chambers 162 and 164. Main body member 110 includes a manifold section 166, which channels the ink from the ink chambers 160, 162, and 164 toward the printhead. Main body member 110, as with other portions of the pen body, is made of glass filled PET (polyester) with a 15% glass fill.

Manifold 166 includes a center ink pipe 168 and two side ink pipes 170 and 172. Ink pipe 168 extends upward from bottom wall 174 and ink pipes 170 and 172 extend outward from sidewalls 176 and 178. Ink pipes 168, 170 and 172 form ink inlets to receive ink from their respective ink chambers. These ink pipes have rectangular cross sections with dimensions of 9.6 mm by 4.5 mm, and thus have internal cross-sectional areas of 43.2 $mm^2$. Filter 136, which is formed of stainless steel wire mesh is heat staked to center ink pipe 168, as shown. Similarly, stainless steel wire mesh filters 138 and 140 are heat staked to side ink pipes 170 and 172, as shown. These filters have the same effective filtering area as the ink pipes to which they are attached, i.e., 43.2 $mm^2$. They have a nominal filtration capability of 15 microns, and a typical thickness of about 0.15 mm.

These filters preclude debris and air bubbles from passing from the foam into the ink pipes. They also provide an important function in preventing spiked surges of ink through the filter. The spaces between the wire strands act as fluid restrictors, which resist fluid flow based on an exponential relationship to the velocity of fluid passing through the filter. Thus, if ink is traveling slowly through the filters, for example during printing, nominal resistance is met at the filter. Without the filter, if the pen were to be jarred, for example, by being dropped, any surges in the ink could easily cause air to be gulped into the firing chambers of the printhead, causing these chambers to deprime. However, with the filter in place, rapid fluid flow through the filters is largely prohibited, so that gulping does not occur.

Center foam member 130 is inserted into center chamber 160 from the Z direction to be compressed by center ink pipe 168 and filter 136. Center foam member 130 compresses down over and extends around the perimeter of ink pipe 168 and filter 136, as shown. This compression and overlap of foam member 130 around the perimeter of ink pipe 168 and filter 136, because of frictional engagement, greatly inhibits any motion of foam member 130 in any direction normal to the Z direction. Similarly, foam member 132 is inserted into side ink chamber 162 from the X direction shown in FIG. 5 to be compressed by and to conform around the perimeter of side ink pipe 170 and filter 138. Foam member 134 is inserted into ink chamber 164 from the X direction to be compressed by and to conform around the perimeter of ink pipe 172 and filter 140, as shown. The compression of foam members 132 and 134 by their respective ink pipes and filters and their frictional engagement of the perimeter of the ink pipes and filters greatly inhibits any motion of foam members 132 and 134 in any direction normal to the X direction.

The compression of foam members 130, 132, and 134 by their respective ink pipes and filter increases the capillarity of the foam members in the region of their respective ink pipes and filters. This capillarity increase causes ink to be attracted toward the ink pipes 168, 170, and 172. From these conduits, the ink is fed to the back side of printhead 142 from which it can be jetted onto the print medium according to signals received from the printer.

Printhead 142 is based on a substrate formed from an electronics grade silicon wafer. The resistors, conductors, ink channel architecture, and other printhead components are formed on the substrate using photolithographic techniques similar to those used in making integrated circuits. Printhead 142 is a face-shooter design, which means that the ink is fed to the substrate from a position behind the substrate, and the droplets are ejected normal to the substrate surface. Because the ink is fed to the back side of the printhead, the natural orientation of the ink pipe in face-shooter printheads is normal to and pointing away from the print medium and orthogonal to the scanning direction. One advantage of bringing the ink to the printhead surface from the back side is that the ink contact with the printhead can act as a heat sink to remove heat from the printhead as printing progresses.

As can be seen, the width W1 of the printhead 142 is significantly smaller than the width W2 of the entire pen. As has been stated, minimizing the size of the printhead is important in minimizing the overall cost of the pen because of the relatively expensive components in the printhead. It is also apparent that the only ink-to-ink interface between inks of different colors occurs at the back side of the printhead 142. Specifically, adhesive layer 144 keeps the inks of different colors apart. Thus, even though pen 24 carries a relatively large volume of ink and has a relatively small printhead, the manifold feature 166 allows the printhead to have only one ink-to-ink interface. In other words, there are no seams or other connections at other positions in the printhead where ink of one color might leak into a chamber dedicated to another color. This beneficial feature of having only one ink-to-ink interface is accomplished because of the novel manifold 166 being formed as part of the main body member 110. And because the outer chambers are loaded from the sides, no ink-to-ink interface occurs at the point of attachment of the cover members 112, 114, and 116 to main body member 110. Thus, an ink-to-ink interface is eliminated as compared to previous-generation multi-color HP pens, in which the region of attachment of the ink chamber cover member provided an additional ink-to-ink interface, with the inherent risk of ink mixing.

The center chamber 160 is defined by the space between sidewalls 176 and 178 and extending upwardly from bottom wall 174. The side chambers 162 and 164 are defined to be on the outside of sidewalls 176 and 178 respectively. Ink pipe 168 extends upwardly from bottom wall 174 and into compressive contact with the center foam member 130. Inward walls 176 and 178 extend upwardly from bottom wall 174. Ink pipes 170 and 172 extend outwardly from inward walls 176 and 178, respectively, and into compressive contact with the respective foam members 132 and 134, as shown. Manifold 166 has three ink outlets, 183, 184, and 185. Printhead 142 has three groups of nozzles, 186, 187, and 188. As can be seen, center ink pipe 168 fluidically communicates with center ink outlet 184, and thus with the center group of nozzles 187. Side ink pipe 170 fluidically communicates with ink outlet 183 and hence with nozzle group 186. Side ink pipe 172 fluidically communicates with outlet 185 and hence with nozzle group 188.

It is important that ink pipes 168, 170, 172 extend into compressive contact with the foam to increase the capillarity of the foam in the region of the ink pipes. The filters 136, 138, and 140 also serve an important role in assisting in this compression. In the previous-generation pens produced by the assignee of the present invention, discussed above, these ink pipes extend upwardly, all in the same direction, from a bottom wall of the pen. These ink pipes are all oriented in the same direction, upwardly and away from the bottom wall of the pen. However, in the illustrated pen of the present invention, only one of the ink pipes, ink pipe 168, extends upwardly away from the bottom wall 174. The other two ink pipes, 170 and 172 extend outwardly into their respective ink chambers.

The dimensions of the pen 24 are given in Table 1, below. These dimensions are given for the main ink cavity portion 124 and ignoring the nose portion 126 (FIG. 3). For the portions of pen 24 described, the width is taken along X axis, length is taken along the Y axis, and height is taken along the Z axis. As shown in FIG. 5, center chamber 160 has a bottom width W3 and a top width W4. Chambers 162, 164 have bottom widths W5, W7 and top widths W6, W8 respectively. All dimensions are given in millimeters except where indicated.

TABLE 1

| | Pen 24 Dimensions | | | | | |
|---|---|---|---|---|---|---|
| | Bottom Width | Top Width | Bottom Length | Top Length | Height | Volume (cc's) |
| Center Chamber 160 | 8.05 | 10.29 | 56.64 | 57.73 | 68.07 | 35.71 |
| Side Chambers 162 and 164 | 9.83 | 8.64 | 55.75 | 55.75 | 70.01 | 36.04 |

The following Table 2 compares the height of the three ink chambers 160, 162, 164 against their respective widths. Since the three chambers each have differing widths along their height, the height/width comparisons are made for the bottom width, top width, and average width of each chamber.

TABLE 2

| | Pen 24 Dimension Ratios | | | | | |
|---|---|---|---|---|---|---|
| | height/width ratios | | | length/width ratios | | |
| | bottom | top | average | bottom | top | average |
| Center chamber 160 | 8.46 | 6.62 | 7.42 | 7.03 | 5.61 | 6.24 |
| Side Chambers 162 and 164 | 7.12 | 8.10 | 7.58 | 5.67 | 6.45 | 6.04 |

Thus the height/width ratios are all at least 6, with most of them at least 7. They range from about 6-½ to about 8-½. The height/width ratios using the average widths of the chambers are all at least 7, and are close to about 7-½. The length/width ratios are all at least 5. They range from about 5-½ to about 7. The length/width ratios using the average widths of the chambers are all in about the 6 to 6-¼ range.

The dimensions and dimension ratios of the chambers of pens 24 can be compared to corresponding values of previous-generation pens produced by Hewlett-Packard Company, the assignee of the present invention. The following Table 3 gives the dimensions and key dimension ratios of previous-generation HP pens, as identified by their commonly known and widely used model numbers.

TABLE 3

| | Previous-Generation HP Pens | | | | |
|---|---|---|---|---|---|
| | Cavity Size | | | Cavity Ratios | |
| Pen Type | width | height | length | ht/wid | In/wid |
| 51606A (PaintJet black) | 22.6 | 32.8 | 31.4 | 1.45 | 1.39 |
| 51606A (PaintJet color) | 6.8 | 33.0 | 32.8 | 4.89 | 4.86 |
| 51608A (DeskJet black) | 25.3 | 41.2 | 34.3 | 1.66 | 1.36 |
| 51625A (DeskJet color) | 14.2 | 42.0 | 25.6 | 2.96 | 1.80 |

As indicated in Table 3, DeskJet 51608A color pens have a height/width ratio 2.96 and the length/width ratio is 1.80. A question that must be resolved, however, is what is the "width" of the chambers in the 51625A DeskJet color pen. For the purposes of the above tables, the narrowest dimension, which is in the media-advance direction, is selected as the width dimension. If the dimension along the scanning direction (when the pen is installed in the printer) is chosen as the width, then the width and length measurements would be interchanged in the above tables. The chambers in the 51625A color pens are narrower in the paper-advance direction because they are transversely oriented, or arranged side by side in the paper-advance direction, rather than in the scanning direction. This transverse orientation creates the need for a complicated manifold to duct the ink from the ink chambers to the printhead. This manifold must be formed as a separate part and attached, e.g., by adhesive or ultrasonic weld to the bottom of the pen. The manifold thereby introduces undesirable additional ink-to-ink interfaces between inks of different colors at locations where pen parts are attached to each other.

PaintJet 51606A color pens have a height/width ratio of 4.89 and a length/width ratio of 4.86. Thus, the PaintJet color pen chambers have close to a square cross section as viewed from the side, and may be considered as having a narrow aspect ratio. PaintJet color pens avoid the problem of multiple ink-to-ink interfaces between pen body parts. However, these pens have the undesirable trait of having a very wide printhead. This wide printhead is expensive and also places the nozzles groups corresponding to the three colors farther apart than is desirable for improved print quality.

It is significant to note that the height/width ratio of the pen 24 chambers are between 35 to 73% greater than the height/width ratio of the PaintJet color chambers. In terms of absolute height, the height of the pen 24 chambers is about 70 mm (excluding the nose portion 126); whereas the height of the PaintJet color chambers is just 33 mm. Therefore, the pen 24 chambers are more than twice as tall as the PaintJet color pen chambers.

Previous HP foam-based pens have the ink pipe extending upward into the foam from a bottom interior wall of the pen. This upward orientation, normal to the printhead surface and to the print medium is the natural orientation for the ink pipe in face-shooter pens. However, because of the absolute height of pen 24 and its height/width aspect ratio, loading the foam into the ink chambers from the top would be difficult without introducing wrinkling or other anomalies in the foam that cause stranding of ink.

Pen 24 also has narrow aspect ratio ink chambers, since it has both a height/width or length/width ratios of 4 or more. Even though the ink chambers in pen 24 have narrow aspect ratio ranges as indicated in Table 2, the foam members are loaded into their respective chambers 160, 162, and 164 without introducing the above-mentioned problems associated with narrow aspect ratio ink chambers. This is true because of various factors. First, the foam members are highly felted, which provides these foam members enhanced stiffness. In addition, the foam members are felted to have final dimensions close to the interior cavity dimensions of their respective chambers. (Felting is discussed more completely in reference to FIGS. 6 and 7.) In center chamber 160, which must be loaded top down, the chamber has a greater width near its top than near its bottom, so that the walls of the chamber increasingly compress the foam as it is loaded.

Finally, the outer chambers 162 and 164 of pen 24 open to the side, rather than from the top, and the foam members 132 and 134 are loaded from the outward side. This produces the result that foam members 132 and 134 only need to be loaded over a very small distance (about 9 mm) into the pen body before they in compressive contact with their ink pipes. Therefore, problems related to foam insertion, such as ink stranding and uncertain contact with the ink pipe, are minimized. In addition, assembly costs are reduced, because there is no need for specialized tools to insert the foam into the pen body. The foam can be fairly simply inserted into the outer chambers.

An important issue that must be considered is the molding process that must be used to form the pen body parts. Ink-jet pen bodies are typically formed of injection molded plastic. The chambers of the previous generation HP foam-based pens have their ink pipes extending upward from the bottom of the chambers and are formed to have the foam inserted from openings from the top of the chambers. These chambers are therefore formed as deep interior cavities. To form such a deep cavity, a molding part must extend deeply into the plastic part being molded. In the case of three-chambered pens, there must be three such mold parts closely spaced side by side. After the plastic is injected into the mold and around the molding parts to form the pen body, the deep mold sections must be removed from the ink chambers. The greater the height/width and/or length/width ratios are, the more difficult it is to remove these mold sections without damaging the molded part. If all three of the chambers in pen 24 were formed as deep cavities so that the foam was inserted from the top down, the molding assembly would be very difficult to design, if indeed possible at all, because of the difficulty in removing interior molding parts from three such deep, side-by-side chambers.

Center chamber 160 is formed as a deep cavity. However, the problems with such deep chambers are solved to some degree in the center chamber by forming the center chamber to have an increasing width from the bottom toward the top. Since the exterior of the pen has a generally rectangular shape, the outside chambers must therefore have a decreasing width from the bottom toward the top. Thus, it is feasible to have one chamber (the center chamber) have such an increasing width, but it would not be feasible to have all three chambers have such an increasing width, unless the pen had a non-rectangular outer form factor, or if the walls of the pen were of non-uniform wall thickness. Either of these alternatives are undesirable.

Before foam body members 130, 132, and 134 are inserted into pen 24, they must be "felted." As stated, foam body members 130, 132, and 134 are preferably formed of reticulated polyurethane foam. Felting is a process in which foam is subjected simultaneously to heat and compression, which causes the foam to take a set and retain its compressed state. The felting process is described in reference to FIGS. 6 and 7. Before felting, the foam has an average pore size of 85–90 pores per inch, a density of about 1.3 lbs. per cubic foot, and a thickness of about 2.3 inches.

Figure 6:
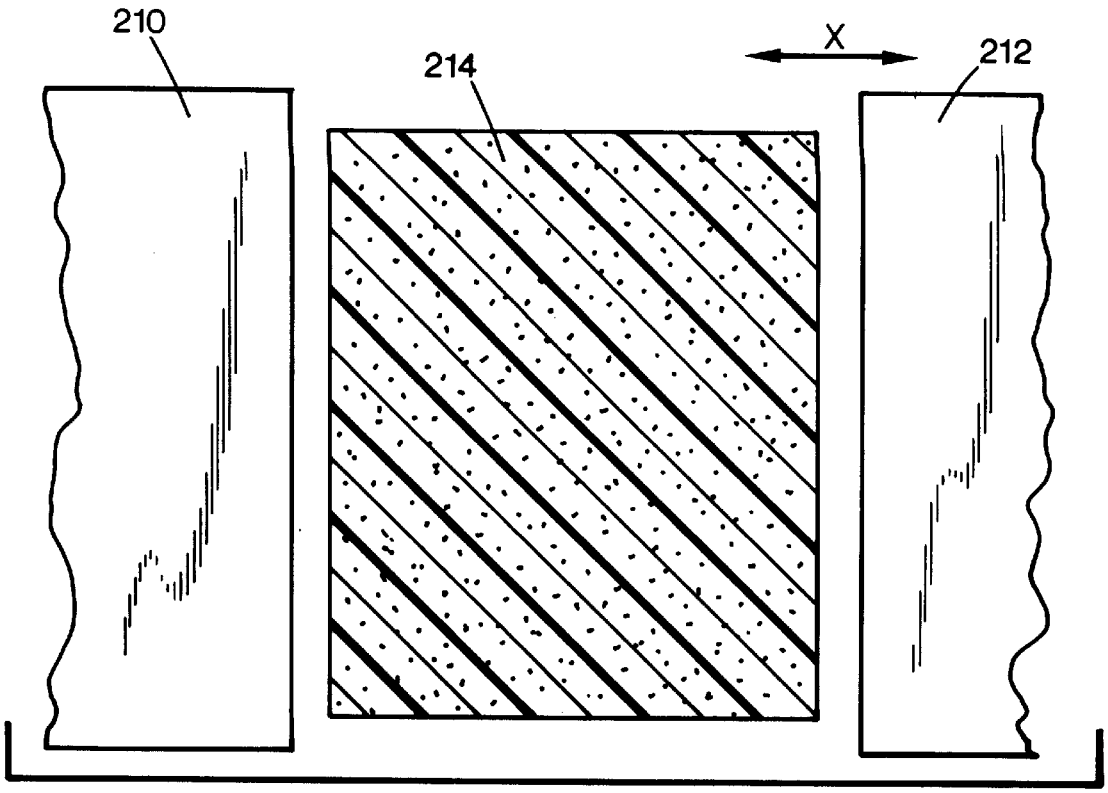
FIGS. 6 and 7 are side views of a felting mechanism.
Figure 7:
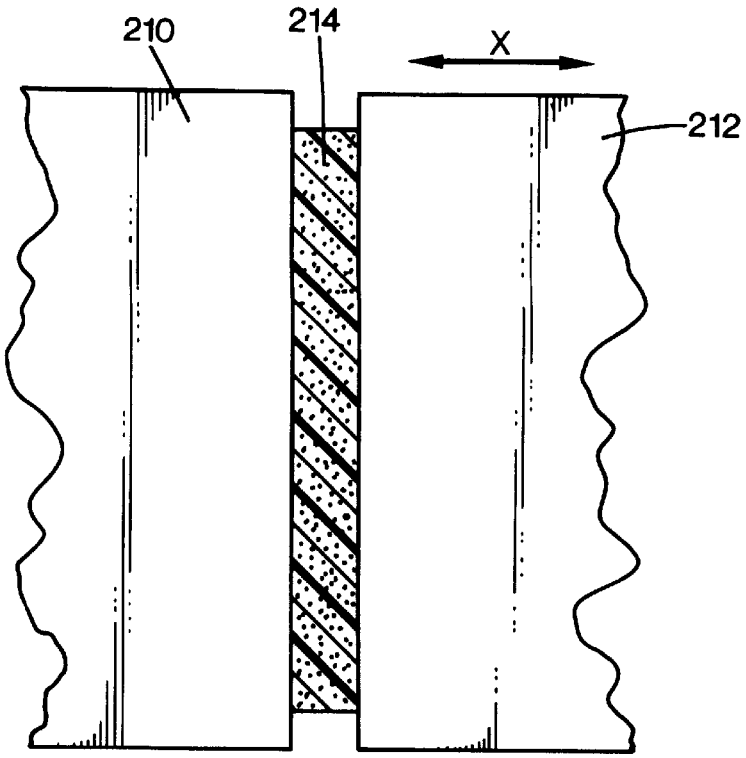

In FIGS. 6 and 7, two felting presses 210 and 212 are used to felt a reticulated polyurethane foam member 214. As shown in FIG. 7, the felting presses 210 and 212 are brought closer together to compress foam member 214. At the same time, heat is applied through felting presses 210 and 212, which causes the internal structure of foam member 214 to take a set and to retain its compressed configuration shown in FIG. 7. The foam is felted at 360° F. for 35 minutes. After felting, the foam has a thickness of about 0.42 inches. Thus, as compared to their uncompressed state as shown in FIG. 7, the foam body members 130, 132, and 134 are felted a total of 548% before insertion into the pen body. Stated another way, the foam is felted to about 18% of its pre-felted state. The foam used in pen 24 has a significantly higher felting than previous-generation HP pens.

A large slab of foam is felted, and the foam members are cut from this slab. Foam members may be either cut with saws or die stamped. Die stamping is preferred because it is more efficient and less expensive. Felting makes the foam bodies much easier to die stamp because the felted foam is stiffer and resists rolling around the edges during the stamping process. If the foam is not felted, it is not as stiff, and the edges roll excessively during the stamping process. Even if the foam body is felted and die stamped, it is preferable to do a finishing step of sawing certain edges of the foam body to make them more square, particularly the edges parallel to the Z axis as shown in FIG. 4, such as edges 218, 220, 222, and the other vertical edge not shown.

A benefit of the felting process is that it aids in the insertion of the foam members into the pen body. This is particularly true of the center foam member 130. The felting process makes the foam more stiff in the Z direction as viewed in FIGS. 4 and 5. The center chamber 160 is particularly long and narrow. It is difficult to insert a foam member in such a long narrow chamber. However, the stiffness of the foam after being felted allows the foam member to be more easily inserted in to the center chamber and reduces the likelihood that wrinkles or non-uniformities occur in the foam. It is extremely important to avoid such non-uniformities, because at each position where the foam has localized high compression, the foam at these positions will have a slightly higher capillarity and will cause a certain amount of ink to be stranded at these locations in the foam.

Additionally, this stiffness helps in maintaining a positive compression and seal between ink pipe 168 and foam member 130. Foam members 132 and 134 are much more easily inserted into the side chambers 162 and 164. But even in this orientation the additional stiffness achieved by the felting process helps in keeping the foam bodies 132 and 134 in compressive contact with ink pipes 170 and 172. For the foam in all three chambers, the felting axis or direction is in the same, and is the direction in which the felting presses 210 and 212 move during the felting process, which is the X direction as shown in FIGS. 6 and 7.

As stated, the center chamber 160 is wider near its top than near its bottom, or closer to the bottom wall 174. The center foam member 130 after felting is about the width of the center chamber near its top. Therefore, the center foam member 130 is additionally compressed by inward walls 176 and 178 as the center foam member is inserted into center chamber 160.

Loading of the foam in the center chamber is improved over previous generation pens because of the "near net" size of the foam slabs used in pen 24. The volumes of the ink chamber cavities as compared to the volume of the foam prior to insertion is set forth in the following Table 4.

TABLE 4

| Volume Comparisons (cc's) | | | |
|---|---|---|---|
| Pen Type | Cavity | Foam | Foam/Cavity Ratio |
| 51606A (PaintJet black) | 23.28 | 35.28 | 1.51 |
| 51606A (PaintJet color) | 7.36 | 10.98 | 1.49 |
| 51608A (DeskJet black) | 36.53 | 67.69 | 1.85 |
| 51625A (DeskJet color) | 15.27 | 23.99 | 1.57 |
| Center Chamber 160 | 35.71 | 45.13 | 1.26 |
| Side Chambers 162, 164 | 36.04 | 44.18 | 1.23 |

Thus in the previous generation HP foam-based pens, the foam/cavity volume ratios are on the order of about 1.5 or greater. This means that the overall volume of foam before insertion into the chambers was at least 50% greater than the actual volume of the chamber into which the foam was inserted. This requires that the foam be squeezed into the chambers during the insertion process. This squeezing requires additional machinery to insert the foam into the chambers while it is compressed by some means.

Before the development of the present invention, it was believed that this extra pre-insertion volume of foam was necessary to achieve proper compressive contact between the foam, the interior walls of the pen, and the ink pipe. However, because of the increased felting of the foam members in pen 24, which adds significant amounts of stiffness, the foam members can be closer to the cavity volume before insertion into the cavity. As shown in Table 3, the foam members of pen 24 have a pre-insertion volume that is between 1.23 to 1.26 times the cavity volume. The foam members thus have a pre-insertion volume that is about 125% of the cavity volume, which in effect becomes the post-insertion volume. A pre-insertion volume that is less than 130% of its post-insertion volume is preferable, and a pre-insertion volume about 125% is highly preferable. A pre-insertion volume less than 130% of the post-insertion volume is considered to be "near net size."

Figure 8:
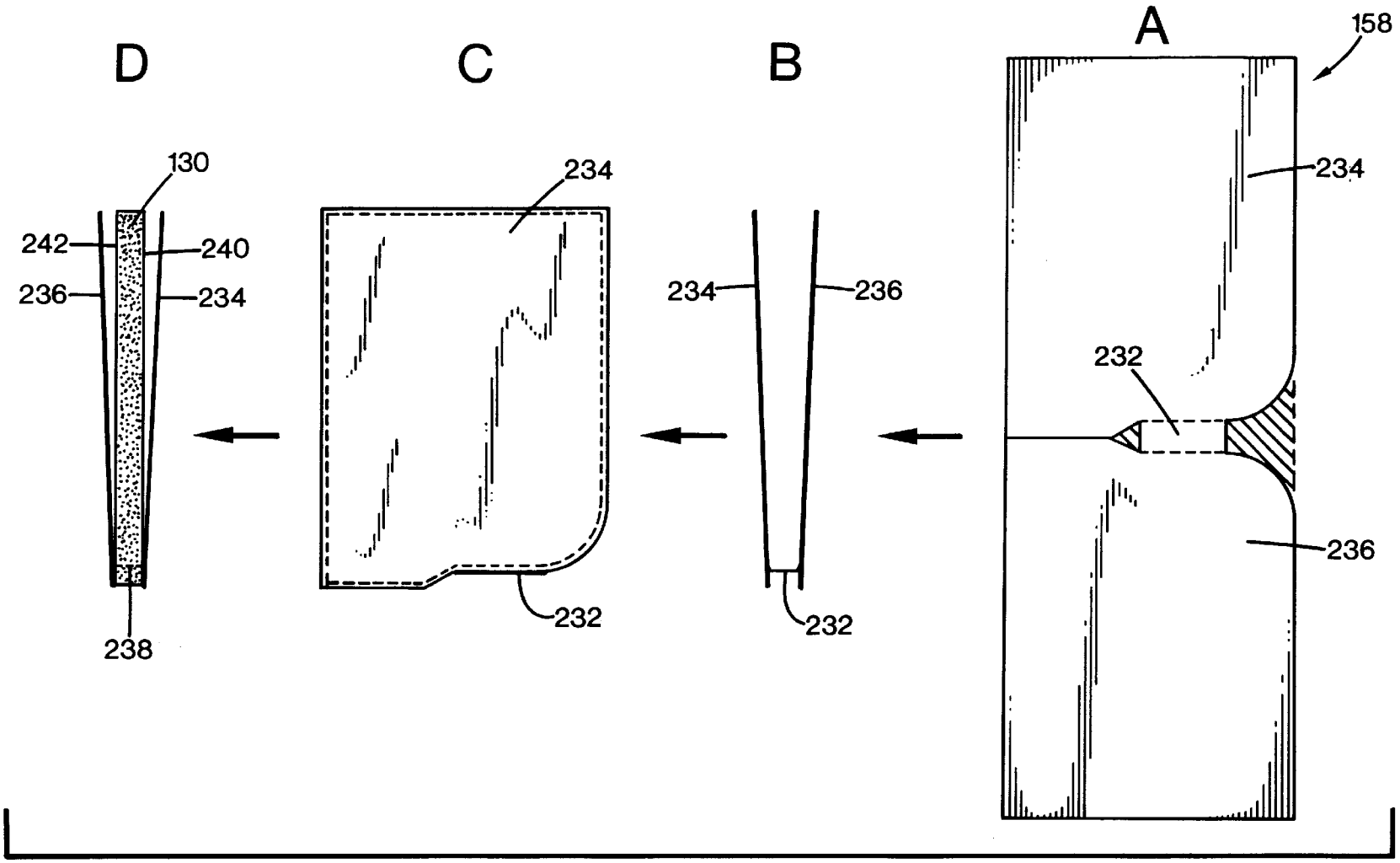
FIG. 8 illustrates sequential steps for forming a low-friction cover sheet 158 for the center foam member 130.

FIG. 8 illustrates a sleeve or envelope 158 that may be used to wrap the center foam member 130 before it is inserted into the tall narrow center chamber to aid in the insertion. First, a sheet of low-friction material is cut as shown at the far right in FIG. 8. One useful material that has been found for this sheet is a material known by the tradename Tyvek (R) available from E. I. DuPont de Nemours & Co., Inc. of Wilmington, Del. Other usable materials include Mylar (TM) or Mylar with a Teflon (TM) coating. Mylar and Teflon are also available from DuPont. Within the interior of the rectangular sheet 158, the solid lines or curves represent cuts and dotted lines represent folds. The portions represented by cross hatching are cut out and discarded. The sheet 158 is folded to appear as shown at position B in FIG. 8. Portion 232 forms a saddle that rests under foam member 130 as shown. Sheet 158 thus is comprised of saddle 232 and side portions 234 and 236.

The sheet 158 is then wrapped around center foam member 130 as shown at positions C and D of FIG. 8. This saddle 232 is in contact with the bottom face 238 (See FIG. 4) of foam member 130, side portion 234 is in contact with side face 240 of foam member 130, and side portion 236 is in contact with side face 242 of foam member 130. Saddle portion 232 keeps the sheet of material 158 in place on foam member 130 as it is inserted downward into the interior of center chamber 160. Saddle 232 allows sheet 158 to resist the frictional forces against the sides of the ink chamber 160 as the sheet 158 and foam member 130 are inserted into chamber 160.

In another embodiment, sheet 158 is formed as two separate sheets and attached to the sides of foam member 130. In this embodiment, these separate sheets are identical to portions 234 and 236, while saddle portion 232 is cut out. These separate sheets 234 and 236 are attached to the sides 240 and 242 of foam member 130 by an appropriate adhesive before insertion into center chamber 160.

In another advantageous embodiment, sheet 158 is formed of a material that expands when exposed to ink. As sheet 158 swells up when in contact with the ink, it fills in any voids that may exist between the foam and the chamber walls and assists in avoiding the possibility of an air path forming around the sides of the foam and into the ink pipe 168. This material is also preferably porous. A porous material acts in conjunction with the foam to contain the ink by capillary action at the appropriate backpressure. The material used also preferably has a lower coefficient of friction than foam member 130 and is preferably strong enough when dry to resist tearing during insertion of the sheet 158 and foam member 130. Surprisingly one usable material for sheet 158 is paper, since most inks, which are typically water based, cause the cellulose paper fibers swell up. Most paper becomes significantly more fragile after it has been wetted. However, the foam 130 and sheet 158 are inserted into the chamber 160 with the sheet and foam dry, before ink is injected into the foam, so that the wet tear strength of paper is not a problem. Bond paper provides reasonable strength, expansion, and frictional characteristics. Although the sheet 158 is disclosed herein as being usable for the top-loaded center chamber of a three-chambered pen, it is also adaptable for use in a single color pen or in multiple ink chambers of a multi-chambered pen.

Thus, an ink containment device, and a method of manufacturing such a device, are disclosed that avoid the problems associated with insertion of large relative volume foam bodies into ink chambers. The illustrated ink chambers have tall, narrow aspect ratios, yet the foam is inserted with minimum foam wrinkling or compression anomalies. The benefits of the illustrated foam members are especially evident in the center chamber 160, in which the foam member 130 is loaded from the top down. The potential problems with loading foam into such tall, narrow chambers are largely avoided because the foam is near its net size (near its post-insertion volume) before insertion and because it is highly felted along the width direction.

We claim:

1. An ink-jet pen for an ink-jet printing system that scans said pen in a scanning direction across a print medium at a print zone, comprising:

a printhead:

a molded ink chamber having an ink pipe communication with said printhead and having a width in a direction parallel to said scanning direction and a height in a direction normal to said scanning direction that is at least 6 times said widths said ink pipe oriented along said height direction; and a body of reticulated polyurethane foam inserted into said ink chamber along said height direction to engage said ink pipe producing a region of increased capillarity in said foam, said foam having been felted in said width direction and having a volume, before insertion into said ink chamber, which exceeds the internal volume of said ink chamber but is less than 130% of the internal volume of said ink chamber.

2. An ink-jet pen according to claim 1, wherein said foam has greater than 70 pores/inch before felting.

3. An ink-jet pen according to claim 1 wherein said ink chamber is a molded ink chamber formed to have a draft angle for separating the said ink chamber from molding devices.

4. An ink-jet pen according to claim 1 wherein said foam is felted at least 500% in said scanning direction before insertion into said ink chamber.

5. An ink-jet pen according to claim 4 wherein said body of foam has a volume, before insertion into said ink chamber, of about 125% or less of the interior volume of said ink chamber before being inserted into said ink chamber.

6. A method of manufacturing an ink-jet pen including:

forming an ink-jet pen body member having an ink chamber with an internal volume, said ink chamber having a width in a first direction and a height in a second direction which is orthogonal to said first direction that is at least six times said width;

felting a first body of reticulated polyurethane foam in a felting direction;

after the first body has been felted, cutting from said body of foam a second body of reticulated foam having a volume which exceeds the internal volume of said ink chamber but is less than 130% of the internal volume of said ink chamber;

inserting said second body of foam into said ink chamber along an insertion direction orthogonal to said felting direction, said insertion direction parallel to said second direction; and filling ink into said second body of foam.

7. A method according to claim 6 wherein said second body of foam is formed to have a volume, before insertion into said ink chamber, about 125% or less of the internal volume of said ink chamber.

8. A method according to claim 6 wherein said foam is felted in said felting direction at least 500%.

9. A method of manufacturing an ink-jet pen including the steps of:

forming an ink-jet pen body member having an ink chamber with an internal volume, said ink chamber having a width in a first direction and a height in a second direction which is orthogonal to said first direction that is at least six times said width, said ink chamber having an open end;

felting a first body of reticulated polyurethane foam in a felting direction;

after the first body has been felted, cutting from said first body of foam a second body of reticulated foam having a volume which exceeds the internal volume of said ink chamber but is less than 130% of the internal volume of said ink chamber;

inserting said second body of foam into said ink chamber along the height dimension of the chamber and through said open end of the ink chamber, and wherein the height dimension is orthogonal to said felting direction; and filling ink into said second body of foam.

10. A method according to claim 9, further comprising the step of installing a cover member at said open end to enclose said second body of foam after said insertion step.

11. A method according to claim 9 wherein said step of forming an ink-jet pen body member includes injection molding the pen body member using a molding device to form the pen body member from a plastic material as a unitary part.

12. A method according to claim 11 wherein said step of forming an ink-jet pen body member further includes forming the ink chamber to have a draft angle with respect to said height dimension for facilitating the separation of said ink chamber from the molding device.

13. A method according to claim 11 wherein said step of forming an ink-jet pen body member further includes forming the ink chamber to have an ink pipe oriented along said height dimension from an end of said chamber opposite said open end, and wherein during said step of inserting said second body of foam, said second body of foam is brought into compressive contact with said ink pipe.

* * * * *